US012662763B2

(12) United States Patent
Kim et al.

(10) Patent No.: US 12,662,763 B2
(45) Date of Patent: Jun. 23, 2026

(54) LAUNDRY TREATMENT APPARATUS

(71) Applicant: LG ELECTRONICS INC., Seoul (KR)

(72) Inventors: Younghun Kim, Seoul (KR); Kunwoo Kim, Seoul (KR); Sungwoon Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 88 days.

(21) Appl. No.: 18/701,332

(22) PCT Filed: Dec. 12, 2022

(86) PCT No.: PCT/KR2022/020094
§ 371 (c)(1),
(2) Date: Apr. 15, 2024

(87) PCT Pub. No.: WO2024/122699
PCT Pub. Date: Jun. 13, 2024

(65) Prior Publication Data

US 2025/0257513 A1 Aug. 14, 2025

(30) Foreign Application Priority Data

Dec. 9, 2022 (KR) ..... 10-2022-0171921

(51) Int. Cl.
*D06F 23/04* (2006.01)
*D06F 37/12* (2006.01)
(Continued)

(52) U.S. Cl.
CPC ..... *D06F 39/02* (2013.01); *D06F 23/04* (2013.01); *D06F 37/12* (2013.01); *D06F 39/022* (2013.01);
(Continued)

(58) Field of Classification Search
None
See application file for complete search history.

(56) References Cited

U.S. PATENT DOCUMENTS

2022/0010474 A1* 1/2022 Kim ..... D06F 23/025

FOREIGN PATENT DOCUMENTS

CN 107304512 A 10/2017
JP 2022-522691 A 4/2022
(Continued)

*Primary Examiner* — Levon J Shahinian
(74) *Attorney, Agent, or Firm* — Birch, Stewart, Kolasch & Birch, LLP

(57) ABSTRACT

A laundry treatment apparatus includes a cabinet including a top cover having an introduction opening, a tub provided in the cabinet to store water and having a tub opening, and a storage provided at the top cover to store detergent and exposed at at least a portion thereof to an outside. The storage includes an installation unit provided at the top cover so as to communicate with the tub, and a storage body removably coupled to the installation unit to store detergent. The storage body is separated from the installation unit when moved from a first position at which the storage body is coupled to the installation unit and to a second position which is spaced apart from the first position in a width direction of the cabinet. The second position is defined within a width of the cabinet.

20 Claims, 13 Drawing Sheets

(51) Int. Cl.
*D06F 39/02* (2006.01)
*D06F 39/12* (2006.01)

(52) U.S. Cl.
CPC ..... *D06F 39/024* (2013.01); *D06F 39/028* (2013.01); *D06F 39/12* (2013.01)

(56) References Cited

FOREIGN PATENT DOCUMENTS

| | | | |
|---|---|---|---|
| JP | 2022-127188 | A | 8/2022 |
| JP | 2022-169163 | A | 11/2022 |
| JP | 2022-172571 | A | 11/2022 |
| KR | 10-2006-0124982 | A | 12/2006 |
| KR | 10-2018-0080013 | A | 7/2018 |
| KR | 10-2020-0007549 | A | 1/2020 |

* cited by examiner

【Figure 1】
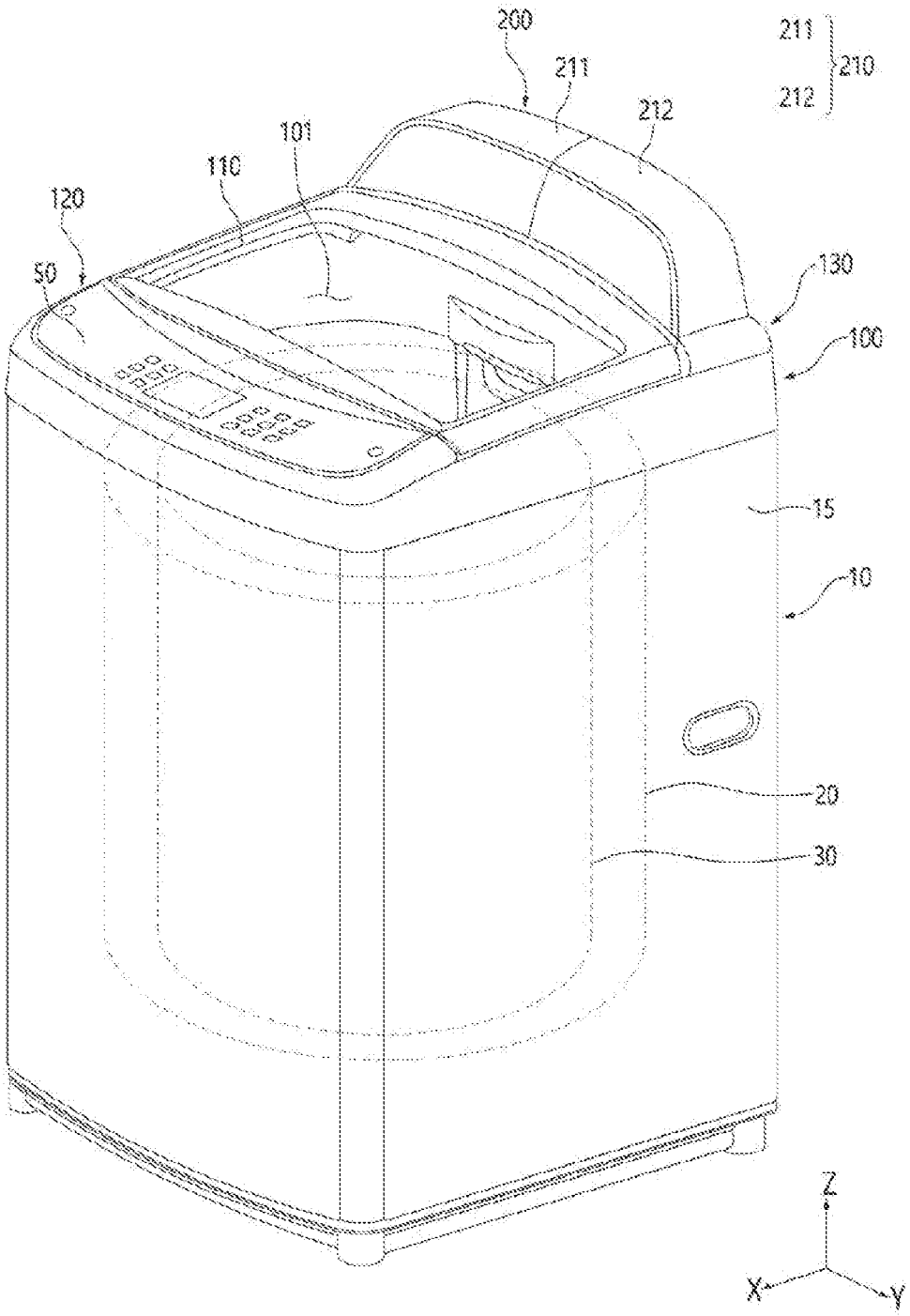

【Figure 2】
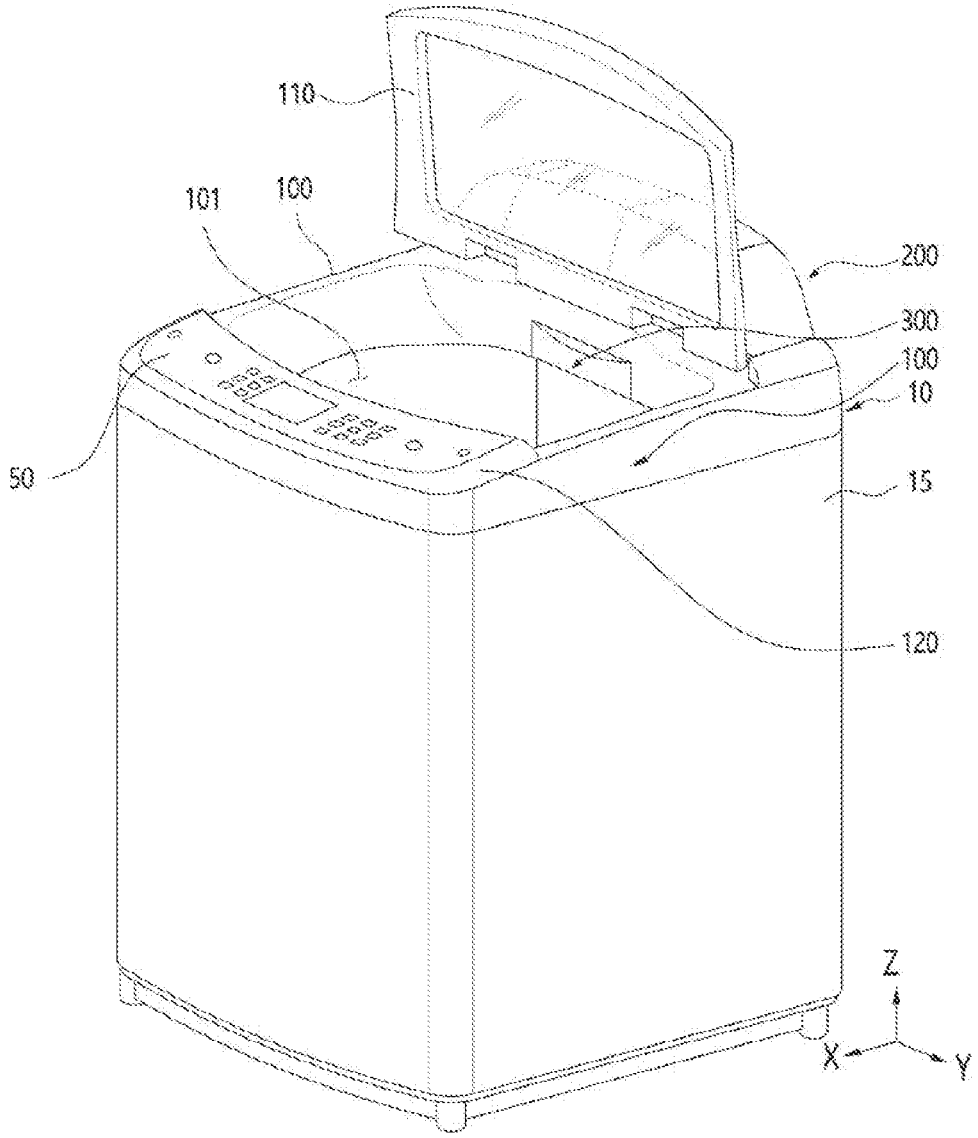

【Figure 3】
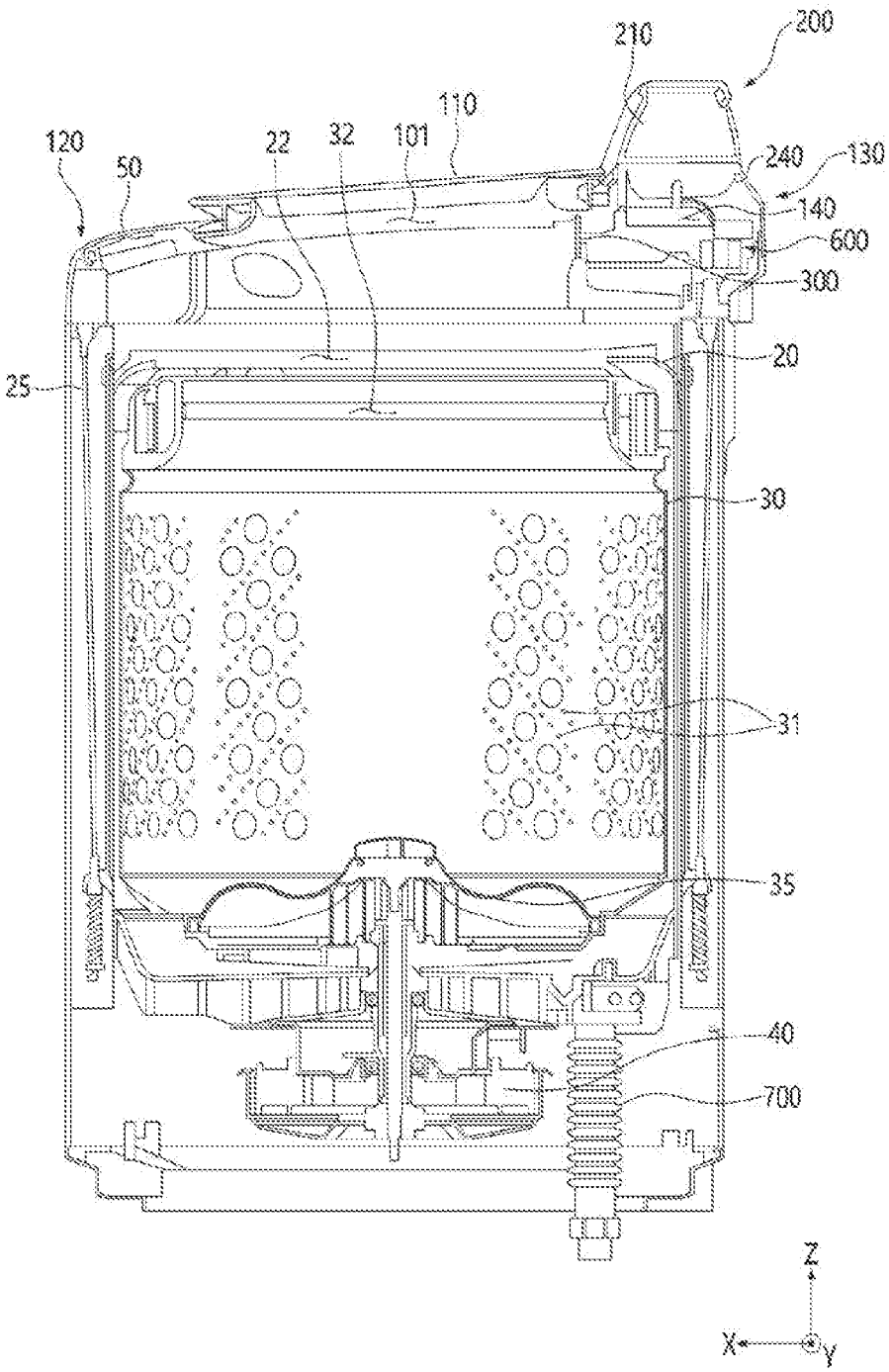

【Figure 4】
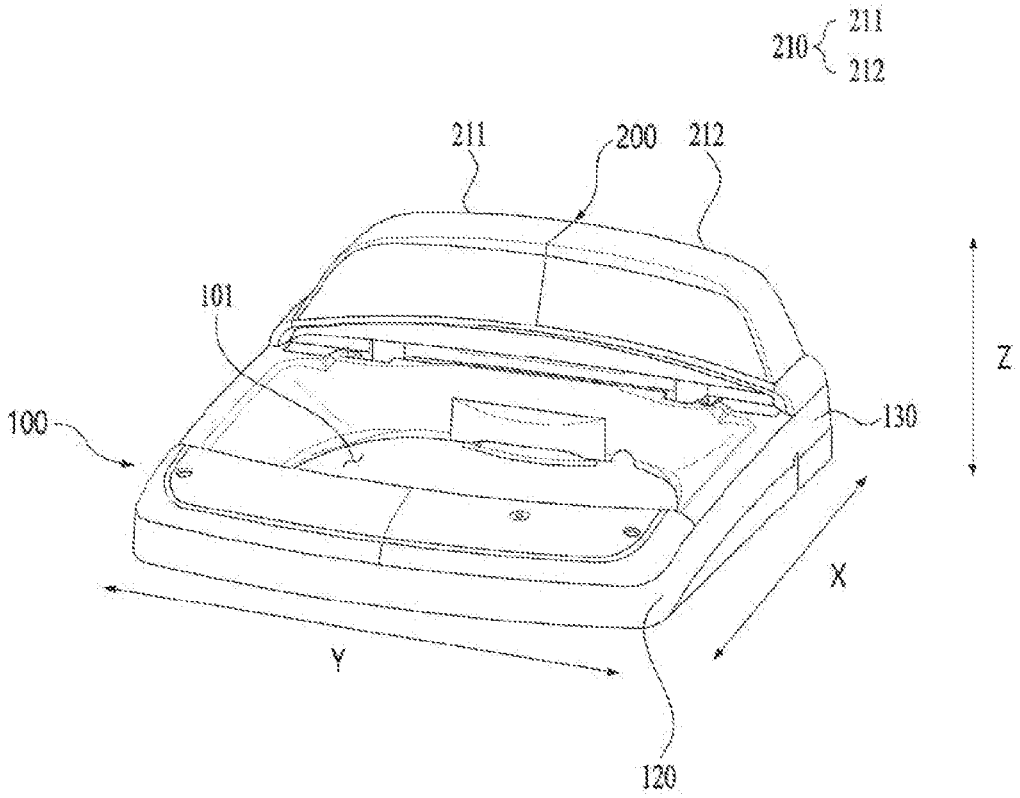

【Figure 5】
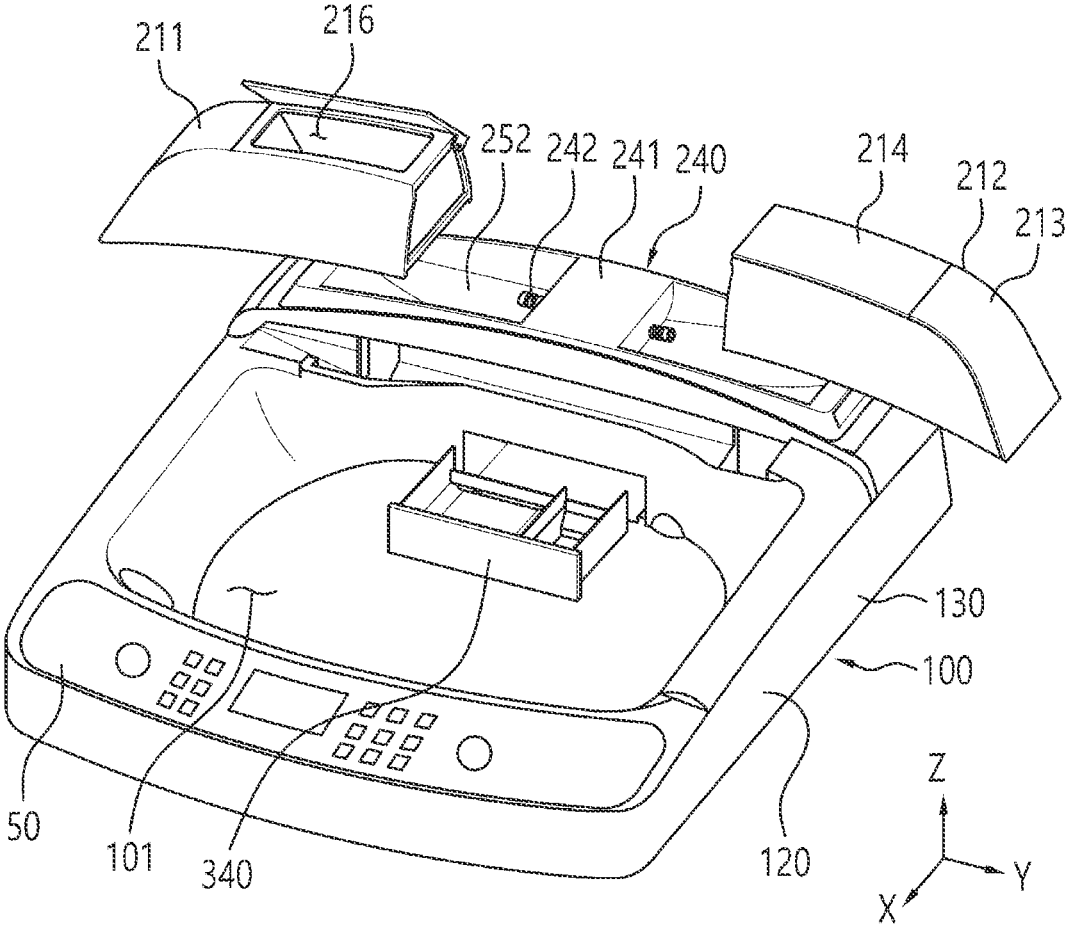

【Figure 6】
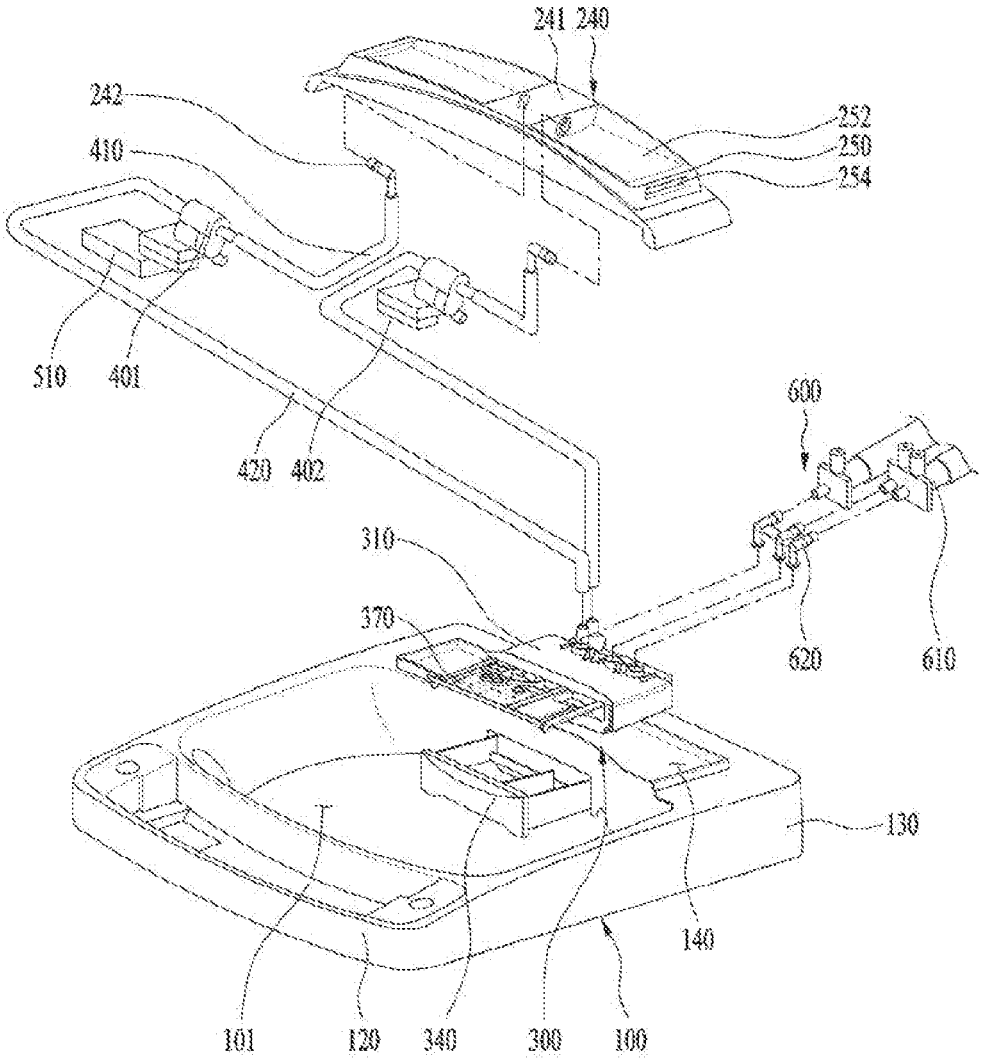

【Figure 7】
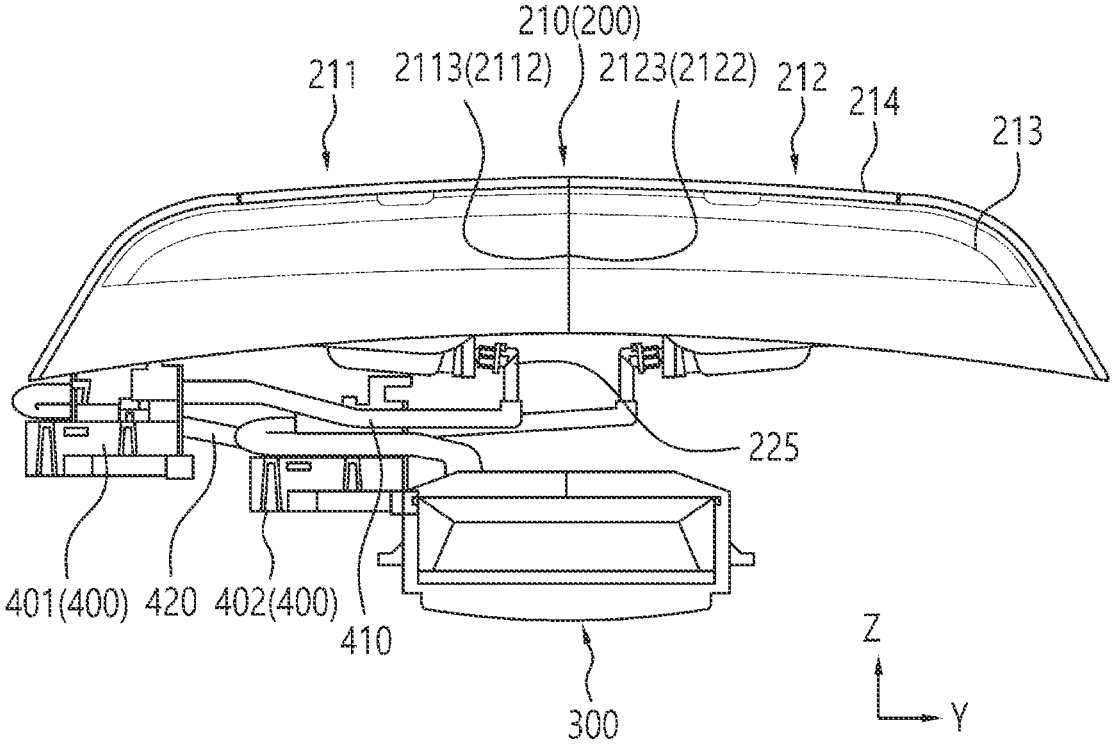

【Figure 8】
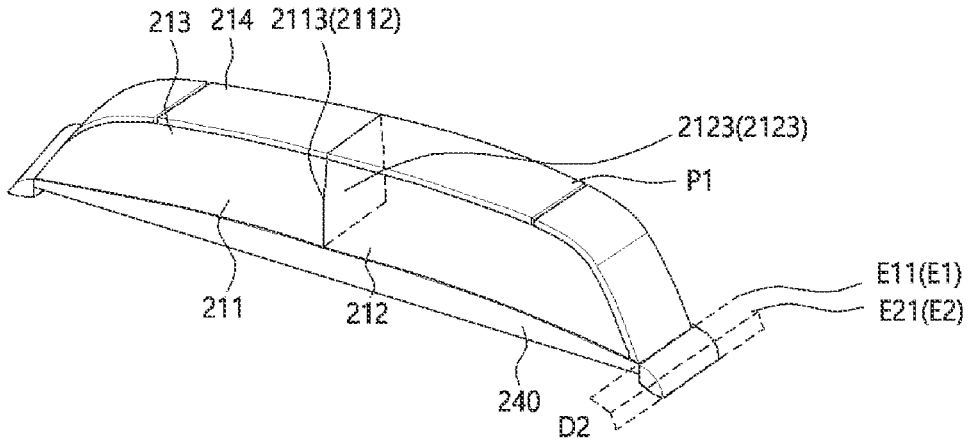
( a )
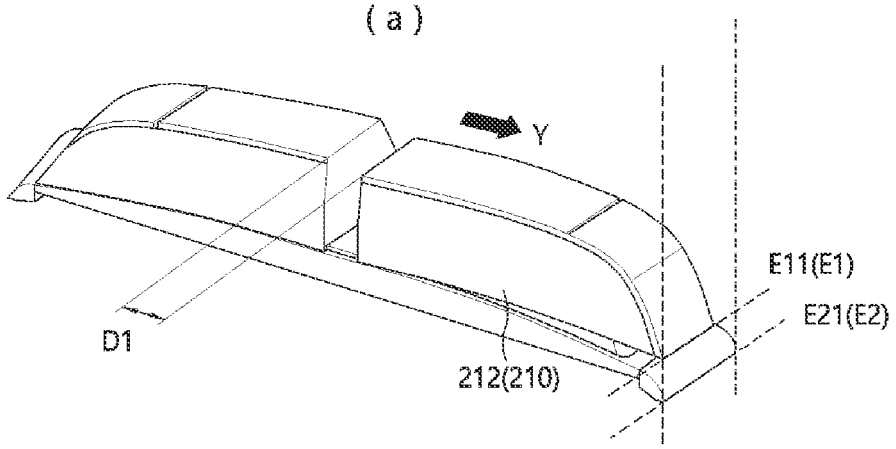
( b )
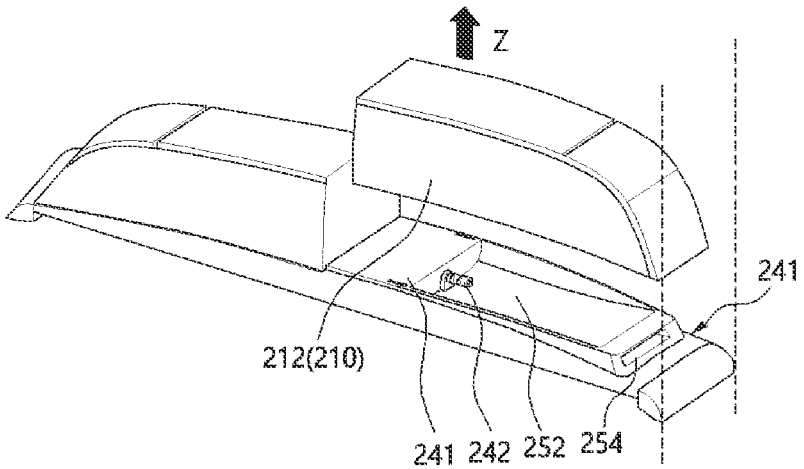
( c )

【Figure 9】
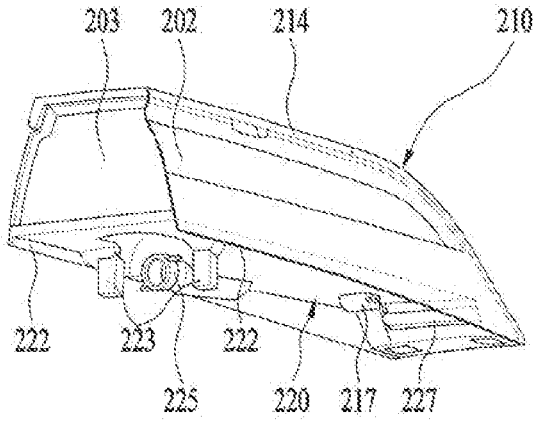
【Figure 10】
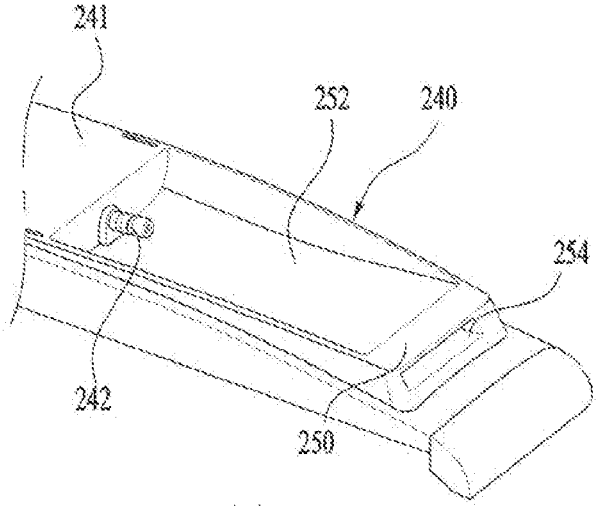

【Figure 11】
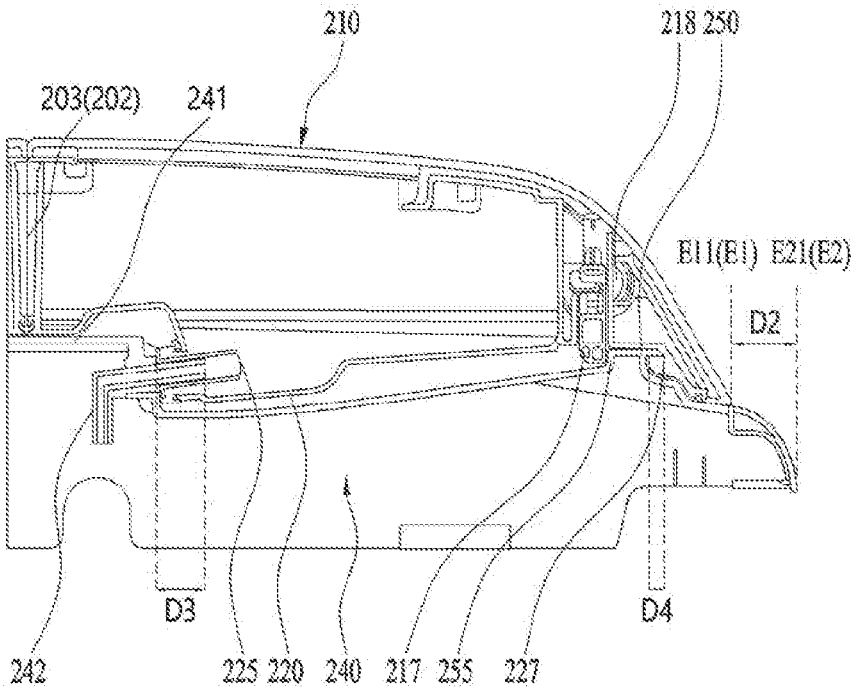

【Figure 12】
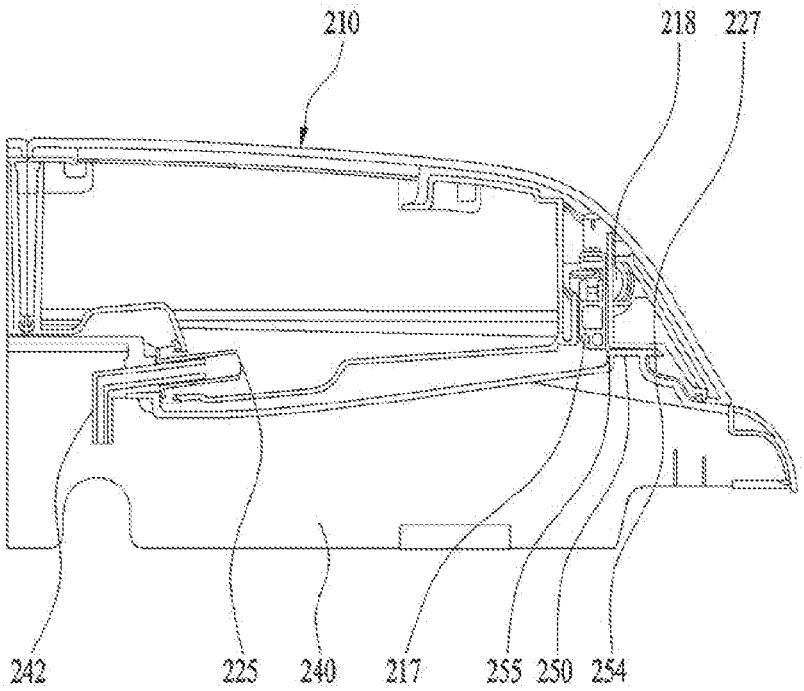

【Figure 13】
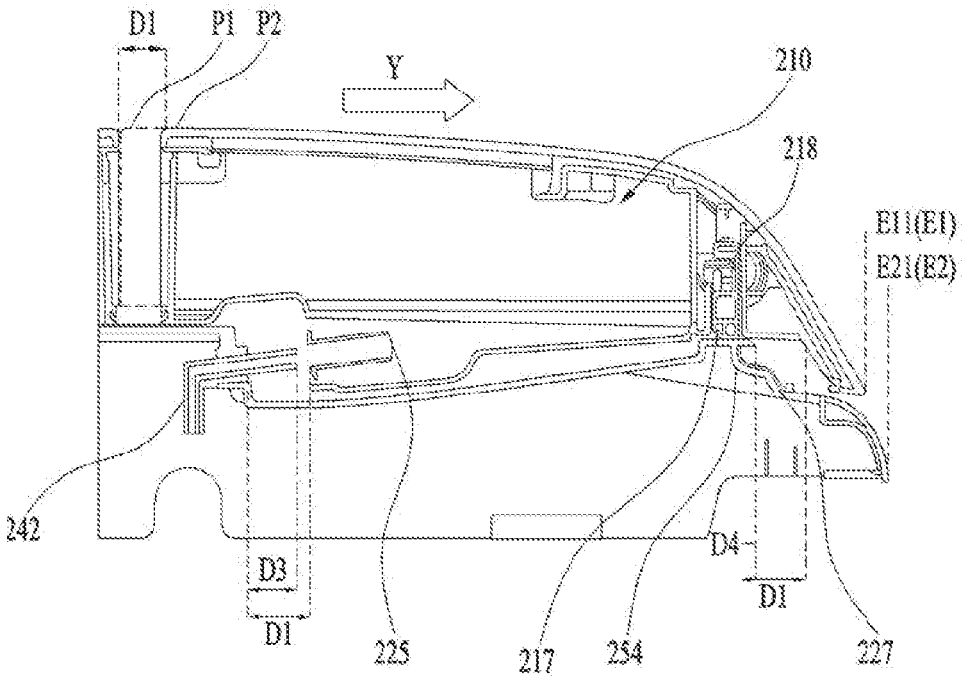

【Figure 14】
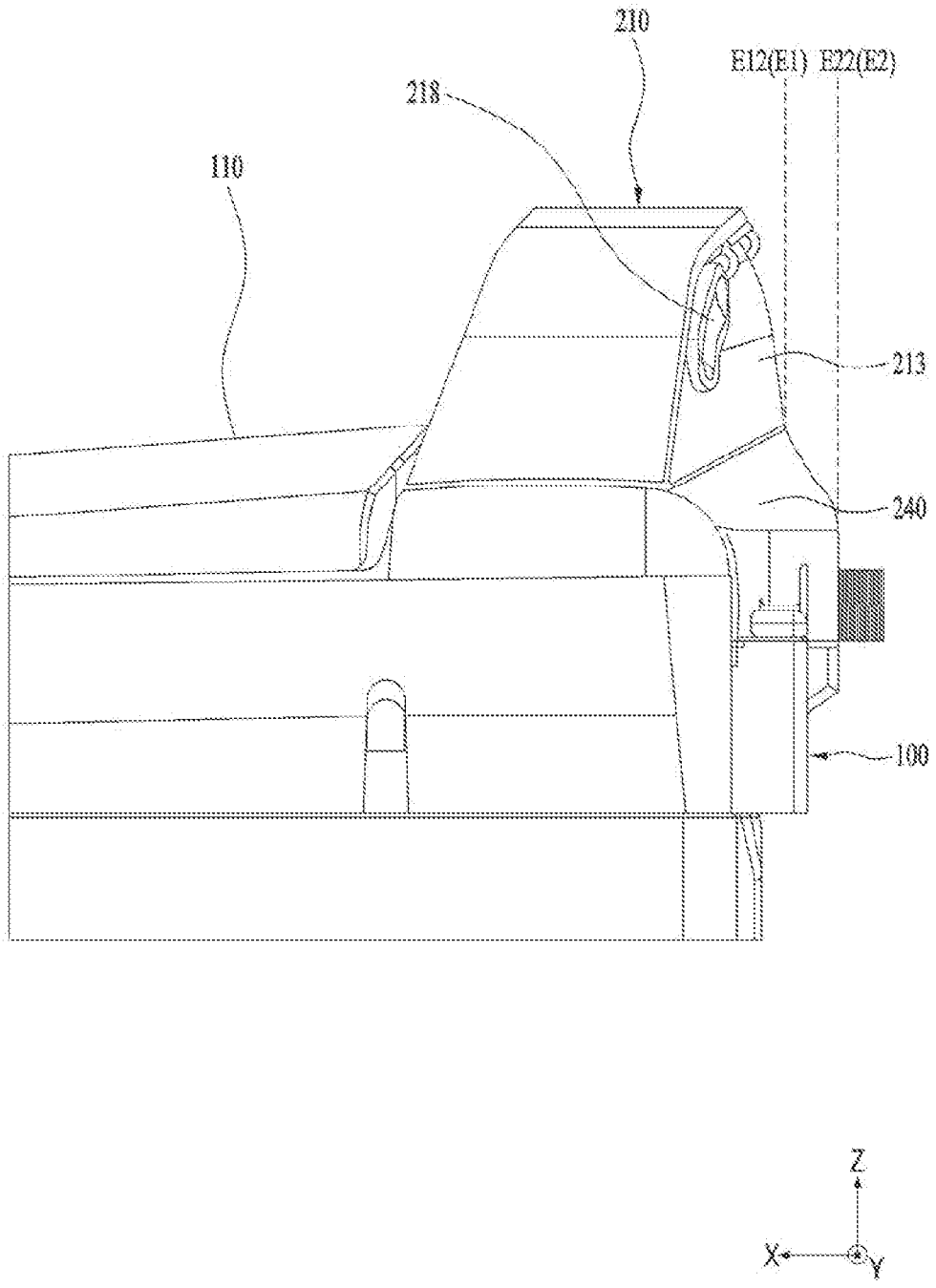

LAUNDRY TREATMENT APPARATUS

CROSS REFERENCE TO RELATED APPLICATIONS

This application is the National Phase of PCT International Application No. PCT/KR2022/020094, filed on Dec. 12, 2022, which claims priority under 35 U.S.C. 119(a) to Patent Application No. 10-2022-0171921, filed in the Republic of Korea on Dec. 9, 2022, all of which are hereby expressly incorporated by reference into the present application.

TECHNICAL FIELD

The present disclosure relates to a laundry treatment apparatus, and more particularly to a laundry treatment apparatus including a storage adapted to store detergent therein.

BACKGROUND ART

A laundry treatment apparatus is an apparatus capable of performing a washing course of eliminating contaminants from clothes, bedclothes and the like (referred to hereinafter as a laundry) introduced into a drum. The laundry treatment apparatus is capable of performing a rinsing course, a dewatering course, a spin-drying course and the like, in addition to the washing course.

The laundry treatment apparatus may include a cabinet defining the appearance of the apparatus, and a drum rotatably provided in the tub so as to receive laundry therein.

The laundry treatment apparatus may include a detergent supply adapted to introduce detergent into the tub or the drum in order to perform the washing course and the like. When the drum rotates in the state in which washing water and detergent are supplied to the inside of the tub, it is possible to eliminate contaminants from laundry by virtue of frictional action between the laundry and the drum, the washing water and the like.

The detergent supply may have a function of supplying detergent in order to enhance a washing effect. Here, the detergent may include all of materials capable of enhancing a washing effect, such as a laundry agent adapted to cause decomposition and separation of contaminants, a fabric softener adapted to enhance fabric softness of laundry and a bleaching agent adapted to improve color contamination of laundry. The detergent may include all of the form of solid (powder) and the form of liquid (liquid phase).

Korea unexamined patent publication No. 10-2020-0007549 discloses a laundry treatment apparatus including a conventional detergent supply. The conventional detergent supply includes a drawer configured to be drawn out of a cabinet, and a detergent path which is provided at the drawer to guide detergent to the tub. The above-mentioned conventional manual detergent supply is a type of detergent supply in which detergent introduced into the detergent path is supplied to the tub together with water.

However, because the conventional manual detergent supply is constructed such that a user directly introduces detergent before execution of every washing course, there is a difficulty in introducing a constant amount of detergent, and there is an inconvenience in that a user must introduce detergent every time.

In order to solve this problem, a detergent supply designed to automatically supply detergent during every washing course has been developed. Furthermore, a laundry treatment apparatus which is provided with the above-mentioned automatic detergent supply in addition to a conventional manual detergent supply so as to allow a user selectively to use one of the two detergent supplies has also been developed.

In the case in which an automatic detergent supply is additionally provided, there is a need to assure a space required to accommodate various components of the automatic detergent supply. However, a space for installation of the automatic detergent supply is limited in the laundry treatment apparatus, which is provided with the manual detergent supply and other components.

For example, considering user convenience in handling, although the automatic detergent supply may advantageously be disposed in an upper area of a cabinet, there may be a limitation on an installation space because a control panel and the like, which are manipulated by a user, is disposed at the upper portion of the cabinet.

Furthermore, in a top-loading laundry treatment apparatus in which an introduction opening through which laundry is introduced is provided on the upper surface of a cabinet, because the height of the upper end of a tub increases and an introduction opening for laundry and a door adapted to open and close the introduction opening are provided at the upper portion of the cabinet together with a control panel, compared to a front-loading type of laundry treatment apparatus in which an introduction opening is provided in the front surface of the cabinet, there may be tighter limitations on a space required for installation of the automatic detergent supply.

In order to solve such spatial limitations, a structure in which a storage container which requires a space for storage of detergent, among components of an automatic detergent supply, is exposed to the outside of the cabinet has been suggested.

Korea unexamined patent publication No. 10-2018-0080013 discloses a laundry treatment apparatus in which an automatic detergent supply including a detergent storage container which is exposed to the outside of the cabinet is installed.

The above-mentioned laundry treatment apparatus is constructed such that an automatic detergent supply is additionally provided to a conventional structure including a manual detergent supply and a detergent storage container adapted to store detergent therein is exposed to the outside of the cabinet for assurance of a space required for installation of the automatic detergent supply.

The detergent storage container may be exposed to the outside of the cabinet for efficient enlargement of a space, and may be removable from the cabinet for easy management.

The detergent storage container may be coupled to the cabinet in a direction approximately parallel to the ground surface in order to realize a structure capable of being efficiently fixed to the cabinet. For example, in the case in which the detergent storage container is coupled to the cabinet in a direction perpendicular to the ground surface, a structure capable of stably fixing the detergent storage container to the cabinet in which vibration is generated due to rotation of a drum becomes complicated, and a depth to which the detergent storage container is inserted increases, thus causing inconvenience.

In an actual use environment, a laundry treatment apparatus may be disposed close to a wall defining a dwelling space. In this case, when the detergent storage container is coupled to the cabinet in a direction parallel to the ground surface, movement of the detergent storage container may be hindered and it may be disadvantageous to couple the detergent storage container to the cabinet due to interference with the wall defining the dwelling space.

Accordingly, an important task in the laundry treatment apparatus field is to develop a structure capable of efficiently moving a detergent storage container and of stably coupling the detergent storage container to a cabinet even in a narrow space caused by a wall or the like present near the laundry treatment apparatus.

DISCLOSURE

Technical Task

Embodiments of the present disclosure are intended to provide a laundry treatment apparatus capable of efficiently increasing a storage space for detergent.

Furthermore, embodiments of the present disclosure are intended to provide a laundry treatment apparatus in which a storage body is enlarged and exposed to the outside of a cabinet in order to increase an amount of detergent storage.

Furthermore, embodiments of the present disclosure are intended to provide a laundry treatment apparatus in which a storage body adapted to store detergent therein is capable of being efficiently coupled to and separated from a cabinet.

Furthermore, embodiments of the present disclosure are intended to provide a laundry treatment apparatus in which a storage body is capable of being stably fixed to a cabinet.

Furthermore, embodiments of the present disclosure are intended to provide a laundry treatment apparatus in which a storage body is capable of being efficiently coupled and separated in a narrow installation space.

Technical Solutions

According to an embodiment of the present disclosure, a detergent storage includes a storage body and an installation unit, and the storage body is moved in a width direction of a cabinet and is then coupled to or separated from the installation unit.

Accordingly, even in a top-loading laundry treatment apparatus, the storage body is capable of being efficiently coupled and stably fixed to the installation unit without interfering with operation of a door and the like.

Furthermore, the storage body may be coupled and fixed to the installation unit at a first position, and may be separated from the cabinet at a second position which is defined within the width of the cabinet.

In other words, according to an embodiment of the present disclosure, the storage body may be coupled to or separated from a top cover while moving in a range that does not escape beyond the boundary of the top cover. Accordingly, the storage body may be conveniently coupled to or separated from the top cover even in the state in which the laundry treatment apparatus is surrounded by a wall defining a dwelling space.

The laundry treatment apparatus according to an embodiment of the present disclosure includes the cabinet, the tub, and the storage. The cabinet includes the top cover equipped with an introduction opening, and the tub is provided in the cabinet so as to store water therein and is provided with a tub opening which is open toward the introduction opening.

The storage is provided at the top cover so as to be exposed at at least a portion thereof to the outside of the cabinet, and is configured to store detergent therein.

The storage includes the installation unit and the storage body. The installation unit is provided at the top cover so as to communicate with the tub, and the storage body is removably coupled to the installation unit and is configured to store detergent therein.

The storage body is removable from the installation unit when moved from the first position at which the storage body is coupled to the installation unit to the second position which is spaced apart from the first position in the width direction of the cabinet, and the second position may be defined within the width of the cabinet.

The storage body may be entirely positioned on the top cover at the second position. The boundary of the storage body may be positioned within the boundary of the top cover at the second position.

At the second position, the outermost end of the storage body may be spaced apart from the outermost end of the top cover in the width direction.

The installation unit may include a central portion, which projects upwards, and a seating surface, which extends from the central portion in the width direction, and the storage body may be in contact with the central portion at the first position and may be slidably moved along the seating surface from the first position to the second position.

At the first position, a portion of the storage body may be positioned on the central portion and at least a portion of the remaining portion of the storage body may be positioned on the seating surface.

The storage body may include a plurality of storage bodies, that is, a first storage body and a second storage body, the seating surface may include a pair of seating surfaces, which are disposed at opposite sides of the central portion in the width direction, and the first storage body and the second storage body may be in contact with the central portion at the first position and may slide far away from the central portion to move from the first position to the second position.

At the first position, an end of the first storage body and an end of the second storage body that face each other may be positioned on the central portion.

The installation unit may include a coupling pipe which is inserted into the storage body at the first position, and, based on the width direction, a length that the coupling pipe is inserted into the storage body may be less than or equal to a distance between a boundary of the storage body and a boundary of the top cover at the first position.

Based on the width direction, the length by which the coupling pipe is inserted into the storage body may be less than or equal to a distance between the first position and the second position.

The installation unit may include a central portion, which projects upwards, and a seating surface, which extends from the central portion in the width direction and on which the storage body is seated at the first position, and the coupling pipe may project from the central portion in the width direction.

The coupling pipe may be in communication with the tub, and the detergent in the storage body may flow to the tub through the coupling pipe.

An end of the installation unit in the width direction may include a hook groove into which a hook protrusion provided at the storage body is inserted.

The hook protrusion may be positioned at an outer side than the hook groove in the width direction, and may be inserted into the hook groove in the width direction.

Based on the width direction, a length that the hook protrusion is inserted into the hook groove may be less than or equal to a distance between a boundary of the storage body and a boundary of the top cover at the first position.

Based on the width direction, a length that the hook protrusion is inserted into the hook groove may be less than or equal to a distance between the first position and the second position.

The installation unit may include a projection having the hook groove formed in an outer surface thereof in the width direction, the storage body may include a variable protrusion, which is positioned so as to face an inner surface of the projection at the first position, and the projection may be positioned between the variable protrusion and the hook protrusion and movement thereof may thus be restricted to the width direction at the first position.

The variable protrusion may be variable in position such that the variable protrusion is positioned so as to face the inner surface of the projection in a first state and may be positioned higher than the projection so as to allow movement of the storage body in the width direction in a second state.

The storage body may include a variable button adapted to change the position of the variable protrusion. An embodiment of the present disclosure may further include a door, which is provided at the top cover so as to open and close the introduction opening, and the storage may be positioned behind the door.

The storage body may be positioned in front of a rear end of the top cover in a forward and backward direction of the cabinet at the first position and the second position.

Advantageous Effects

Embodiments of the present disclosure are able to provide a laundry treatment apparatus capable of efficiently increasing a storage space for detergent.

Furthermore, embodiments of the present disclosure are able to provide a laundry treatment apparatus in which a storage body is enlarged and exposed to the outside of a cabinet in order to increase an amount of detergent storage.

Furthermore, embodiments of the present disclosure are able to provide a laundry treatment apparatus in which a storage body adapted to store detergent therein is capable of being efficiently coupled to and separated from a cabinet.

Furthermore, embodiments of the present disclosure are able to provide a laundry treatment apparatus in which a storage body is capable of being stably fixed to a cabinet.

Furthermore, embodiments of the present disclosure are able to provide a laundry treatment apparatus in which a storage body is capable of being efficiently coupled and separated in a narrow installation space.

DESCRIPTION OF DRAWINGS

FIG. 1 is a perspective view illustrating the laundry treatment apparatus according to an embodiment of the present disclosure;

FIG. 2 is a perspective view illustrating the laundry treatment apparatus shown in FIG. 1 in which an introduction opening is open;

FIG. 3 is a cross-sectional view illustrating the interior of the laundry treatment apparatus according to an embodiment of the present disclosure;

FIG. 4 is a view illustrating a top cover of the laundry treatment apparatus according to an embodiment of the present disclosure;

FIG. 5 is a view illustrating the storage body and the installation unit, which are provided at the top cover, according to an embodiment of the present disclosure;

FIG. 6 is a view illustrating a detergent passage of the storage according to an embodiment of the present disclosure;

FIG. 7 is a view illustrating the connection relationships between the storage body and a detergent pump according to an embodiment of the present disclosure;

FIG. 8 is a view illustrating the state in which the storage body is separated from the installation unit, according to an embodiment of the present disclosure;

FIG. 9 is a view illustrating a storage bottom portion of the storage body according to an embodiment of the present disclosure;

FIG. 10 is a view illustrating a seating surface of the installation unit according to an embodiment of the present disclosure;

FIG. 11 is a view illustrating the cross-section of the storage body mounted on the installation unit according to an embodiment of the present disclosure;

FIG. 12 is a view illustrating the state in which the variable protrusion of the storage body is manipulated;

FIG. 13 is a view illustrating the state in which the storage body shown in FIG. 11 is moved to the second position; and FIG. 14 is a view illustrating the storage body coupled to the installation unit according to an embodiment of the present disclosure when viewed in the width direction of the cabinet.

BEST MODE FOR DISCLOSURE

Hereinafter, with reference to the accompanying drawings, embodiments of the present disclosure will be described in detail so that those skilled in the art can easily implement the present disclosure.

However, the present disclosure may be implemented in several different forms and is not limited to the embodiments described herein. In order to clearly illustrate the present disclosure, components not related to the description are omitted, and similar components are denoted by like reference numerals throughout the specification.

In this specification, redundant descriptions of the same components are omitted.

It will be understood that, when an element is referred to as being "connected" or "coupled" to another element, the element can be directly connected or coupled to the other element and an intervening element may also be present therebetween. In contrast, in this specification, it will be understood that, when an element is referred to as being "directly connected" or "directly coupled" to another element, there are no intervening elements present therebetween.

The terminology used herein is merely for the purpose of describing particular embodiments, and is not intended to limit the scope of the present disclosure.

In addition, as used herein, a singular form may encompass the plural form unless context dictates otherwise.

In this specification, it will be further understood that the terms "comprise", "have", etc., specify the presence of stated features, integers, steps, operations, elements, components, or combinations thereof, but do not preclude the presence or addition of one or more other features, integers, steps, operations, elements, components, or combinations thereof.

Furthermore, in this specification, the term "and/or" includes a combination of a plurality of related listed items or any of the plurality of related listed items. In this specification, "A or B" may include "A", "B", or "both A and B.".

FIG. 1 illustrates a laundry treatment apparatus 1 according to an embodiment of the present disclosure. FIG. 2 illustrates the state in which a door 110 of the laundry treatment apparatus 1 is rotated to open an introduction opening 101.

Referring to FIGS. 1 and 2, an embodiment of the present disclosure includes a cabinet 101. The cabinet 10 may define the appearance of the laundry treatment apparatus 1, and may define therein a space in which a tub 20 and a drum 300, which will be described later, are accommodated.

The cabinet 10 may include a cabinet body 15, which has the form of an approximate hexahedron and has a space adapted to accommodate the tub 20, the drum 30 and the like, and a top cover 100 adapted to cover the upper open surface of the cabinet body 15.

The cabinet body 15 may include a plurality of panels. For example, the cabinet body 15 may include at least one of a front panel, a rear panel, a side panel, and a lower panel.

The cabinet body 15 may be constructed so as to be open at the upper surface thereof, and the top cover 100 may be disposed on the upper open surface. The top cover 100 may be coupled to the cabinet body 15 to define the cabinet 10.

Here, the cabinet 10 may include the top cover 100 equipped with the introduction opening 101. In other words, the introduction opening 101 may be formed in the top cover 100 so as to allow laundry to be introduced thereinto. Specifically, an embodiment of the present disclosure may be a top-loading laundry treatment apparatus 1 in which the introduction opening 101 is open upwards and the rotational axis of the drum 30 is perpendicular to the ground surface. However, an embodiment of the present disclosure is not necessarily limited to the top-loading laundry treatment apparatus.

The introduction opening 101 may be an opening formed through the top cover 100, and may be in communication with the inside of the cabinet 10. A user may introduce laundry into the cabinet 10 through the introduction opening 101. The door 110 may be rotatably coupled to the top cover 100, and the door 110 may open and close the introduction opening 101 according to a rotated state thereof.

The top cover 100 may include a front portion 120 and a rear portion 130. The front portion 120 may be defined in the front of the door 110, and the rear portion 130 may be defined in the rear of the door 110.

The front portion 120 of the top cover 100 may be provided with a control panel 50. The control panel 50 may include an output unit adapted to provide a user with information in various manners, and an input unit adapted to receive command inputs from a user in various manners.

The rear portion 130 of the top cover 100 may be provided with a storage 200. The storage 200 may be provided at the top cover 100 so as to be exposed to the outside at at least a portion thereof. Furthermore, the storage 200 may include a space adapted to store detergent therein.

The storage 200 may be constructed so as to project upwards from the top cover 100 at at least a portion thereof. Consequently, it is possible to efficiently assure a space adapted to store detergent. Although FIGS. 1 and 2 illustrate the storage 200, which projects upwards from the top cover 100, the direction in which the storage 200 projects is not necessarily limited to the upward direction.

The storage 200 may be an automatic detergent supply device. In other words, the storage 200 may be designed to supply a predetermined amount of detergent that is previously stored by a user, to the tub 20 during every washing course.

For convenience in use of the storage 200, it is important to assure a detergent storage capacity of the storage 200. An embodiment of the present disclosure is able to efficiently increase the space adapted to store detergent by projecting the storage 200 outwards from the top cover 100.

Here, the storage 200 may include an installation unit 240 and a storage body 210, which will be described later. The storage body 210 may include a space adapted to store detergent therein, and may be detachable from the installation unit 240.

The storage body 210 may be moved in a direction parallel to the ground surface and be detachably mounted on the installation unit 240 so as to efficiently increase a fixing force with respect to the installation unit 240.

When the storage body 210 is coupled to the installation unit 240 in a direction perpendicular to the ground surface, it may be liable to be subjected to a separation phenomenon of the storage body 210 caused by vibration or the like of the laundry treatment apparatus 1, and the depth to which the storage body 210 is inserted may increase in order to stably secure the storage body 210.

Accordingly, according to an embodiment of the present disclosure, it is possible to efficiently decrease the depth to which the storage body 210 is inserted by allowing the storage body 210 to be moved parallel to the ground surface, and is possible to stably secure the storage body 210 by virtue of sliding coupling or the like.

Furthermore, according to an embodiment of the present disclosure, the storage body 210 may be moved in the width direction Y of the cabinet 10 so as to prevent interference with operation of the door 110 which is disposed in front thereof. In other words, the storage body 210 may be moved in the width direction Y and then be coupled to or separated from the installation unit 240.

Meanwhile, FIG. 3 illustrates the interior of the laundry treatment apparatus 1 according to an embodiment of the present disclosure.

Referring to FIG. 3, the cabinet 10 may be provided therein with the tub 20 and the drum 30. The tub 20 may receive water therein, and may include a tub opening 22 which is open toward the introduction opening 101.

According to an embodiment of the present disclosure, the introduction opening 101 may be located at the top cover 100, and the tub opening 22 in the tub 20 may also be open upwards. In other words, the laundry treatment apparatus 1 according to the present disclosure may be a top-loading type in which the axis of the laundry treatment apparatus 1 is perpendicular to the ground surface.

The drum 30 may be provided in the tub 20. The drum 30 may be rotatably provided in the tub 20, and may receive laundry therein. The drum 30 may include a drum opening 32 which is open toward the introduction opening 101.

Accordingly, laundry, which is introduced through the introduction opening 101, may be received in the drum 30 through the tub opening 22 and the drum opening 32. The tub 20 and the drum 30 may each have the form of a cylinder having an internal space, and the drum 30 may be provided in the peripheral surface thereof with a plurality of communication holes 31.

When water is stored in the tub 20, the drum 30 may share the water with the tub 20 because the water in the tub 20 is introduced into the drum 30 through the communication holes 31.

According to an embodiment of the present disclosure, the upper portion of the cabinet 10, that is, the top cover 100 may be provided with the storage 200 and an internal storage 300. The top cover 100 may have a cover space 140 which is formed in the rear portion 130 positioned behind the door 110. The cover space 140 may be defined as a portion of the internal space in the cabinet 10.

The top cover 100 may be open such that the cover space 140 is exposed upwards, and the storage 200 may include the installation unit 240 which is provided to cover the open surface of the cover space 140. The storage 200 may include the storage body 210 in which detergent is stored, and the storage body 210 may be mounted on the installation unit 240 above the top cover 100.

The internal storage 300 may be positioned in the cover space 140. According to an embodiment of the present disclosure, the storage 200 may be configured such that the detergent in the storage 200 is supplied to the tub 20 through the internal storage 300, or may be in communication with the tub 20 independent of the internal storage 300.

The internal storage 300 may receive detergent independent of the storage 200 provided in the top cover 100. The internal storage 300 may be formed through the peripheral surface around the introduction opening 101 in the top cover 100.

The internal space 300 may be in communication with the inside of the tub 20 through the introduction opening 101. When the internal storage 300 is in communication with the storage 200, the detergent stored in the storage 200 may be transferred to the internal storage 300, and the internal storage 300 may supply the detergent stored therein together with the detergent transferred from the storage 200, to the inside of the tub 20.

An embodiment of the present disclosure may include a water supply 600 connected to an external water supply source outside the cabinet 10. The water supply 600 may be in communication with the tub 20 so as to supply water to the tub 20. The water supply 600 may be directly connected to the tub 20, or may be connected to the internal storage 300 so as to supply water to the tub 20 through the internal storage 300.

An embodiment of the present disclosure may include a drive 40. The drive 40 may be positioned under the tub 20, and may be connected to the drum 30 via a drive shaft passing through the tub 20. In other words, the drum 30 may be positioned in the tub 20, and may receive rotative force from the drive 40 via the drive shaft.

The drum 30 may be provided on the bottom thereof with a rotating unit. The rotating unit may be provided so as to cover at least a portion of the bottom surface of the drum 30 from above, and may rotate in conjunction with or independently of the drum 30. A pulsator 35 may be provided in the drum 30.

The rotating unit may be connected to the drive 40. The drive 40 may include a transmission and the like, and the drive shaft may include a solid shaft and a hollow shaft which are connected to the transmission. One of the solid shaft and the hollow shaft may be connected to the drum, and the other of the solid shaft and the hollow shaft may be connected to the rotating unit.

The cabinet 10 may be provided therein with a suspension 25 adapted to support the tub 20 by the cabinet 10. The suspension 25 may include an elastic body and the like in order to reduce vibration transmitted from the tub 20.

Accordingly, since the vibration, which is generated by the drum 30 or the drive 40 and is transmitted via the tub 20, is reduced by virtue of the suspension 25, it is possible to reduce an amount of vibration transmitted to the cabinet 10.

Furthermore, a water discharge 700 may be connected to the tub 20. Consequently, washing water containing contaminants generated during washing course may be discharged to the outside of the cabinet 10 from the tub 20 through the water discharge 700.

Meanwhile, FIG. 4 illustrates the top cover 100 according to an embodiment of the present disclosure which is provided with the storage body 210 and a drawer 340 of the internal storage 300. FIG. 5 illustrates the state in which the storage body 210 and the drawer 340 are separated from the top cover 100 shown in FIG. 4.

Referring to FIGS. 4 and 5, according to an embodiment of the present disclosure, the top cover 100 may include the storage 200 and the internal storage 300. When the internal storage 300 is included, the storage 200 including the storage body 210 may also be defined as an external storage 200.

The internal storage 300 may be provided in the cabinet 10 so as to be shielded by the outside, and the storage body 210 included in the storage 200 may be exposed to the outside so as to allow a user to see the storage body 210 and the like with the naked eyes from the outside.

The control panel 50 may be positioned at the front portion 120 of the top cover 100, and the storage 200 and the internal storage 300 may be provided at the rear portion 130. The storage 200 may be disposed above a rear space, and the internal storage 300 may be disposed in the rear space.

The storage 200 may include the installation unit 240 and the storage body 210, and the installation unit 240 may be provided at the top cover 100 so as to communicate with the tub 20. The storage body 210 may be detachably coupled to the installation unit 240, and may store detergent therein.

The installation unit 240 may be provided at the top cover 100, and may be coupled to the top cover so as to define a portion of the appearance of the top cover 100. The top cover 100 may include the rear space, which has previously been described, and the installation unit 240 may be provided so as to cover the open surface of the rear space. Here, the installation unit 240 may be defined as a portion of the top cover 100.

The storage body 210 may be configured to project upwards from the top cover 100, and may be separated from the installation unit 240. The storage body 210 may include a storage main body 213 adapted to store detergent therein. The storage main body 213 may include a detergent introduction opening 216 through which detergent is introduced by a user.

The storage main body 213 may be provided with a storage cap 214. The storage cap 214 may be rotatably provided at the storage main body 213, and may open and close the detergent introduction opening 216 depending on a rotated state thereof.

A user may separate the storage body 210 from the installation unit 240 for washing or introduction of detergent. However, washing and introduction of detergent may also be performed even in the state in which the storage body 210 is coupled to the installation unit 240.

The installation unit 240 may be provided with a seating surface 252 on which the storage body 210 is seated. The storage body 210 may be positioned on the seating surface 252 so as to be coupled to the installation unit 240. The installation unit 240 may include a coupling pipe 242, which is inserted into the storage body 210 so as to communicate with the inside of the storage body 210.

When the storage body 210 is coupled to the installation unit 240, the coupling pipe 242 may be inserted into the storage body 210 so as to constitute a portion of a passage through which detergent flows.

According to an embodiment of the present disclosure, the storage body 210 of the storage 200 may include a plurality of storage bodies. For example, the storage body 210 may include a plurality of storage bodies, that is, a first storage body 211 and a second storage body 212.

All of the first storage body 211 and the second storage body 212 may be detachably coupled to the installation unit 240. The installation unit 240 may include a plurality of seating surfaces 252 on which the first storage body 211 and the second storage body 212 are respectively seated.

The first storage body 211 and the second storage body 212 may include different spaces adapted to store detergent. Thus, different kinds of detergent may be stored in the first storage body 211 and the second storage body 212. The first storage body 211 and the second storage body 212 may include the detergent introduction opening 216 and the storage cap 214, respectively.

The installation unit 240 may include a central portion 241, which is disposed in the approximate center in the width direction Y of the cabinet 10. The central portion 241 may be configured to project upwards with respect to the seating surface 252.

Seating surfaces may be disposed at opposite sides of the central portion 241 in the width direction Y. Consequently, the first storage body 211 and the second storage body 212 may respectively be positioned at opposite sides of the central portion of the installation unit 240. According to an embodiment of the present disclosure, a plurality of storage bodies 210 including the first storage body 211 and the second storage body 212 may be aligned with each other in the width direction Y of the cabinet 10.

The plurality of storage bodies 210 may be aligned with each other in the direction in which the storage bodies 210 are coupled. Specifically, the plurality of storage bodies 210 may be coupled to and separated from the installation unit 240 in the width direction Y of the cabinet 10, and may disposed in a line in the width direction Y.

The central portion 241 may serve as a stopper adapted to limit the distance that the first storage body 211 and the second storage body 212 are moved so as to be coupled in the width direction Y. For example, the first storage body 211 and the second storage body 212 may be moved to the central portion 241 from opposite sides of the central portion 241 in the width direction Y, and may be brought into contact with the central portion 241 and be coupled to the installation unit 240.

Here, portions of the first storage body 211 and the second storage body 212 may be disposed on the central portion 241 and be supported thereby, and the remaining portions of the storage body 211 and the second storage body 212 may be disposed on the seating surface 252 and be supported thereby.

The internal storage 300 may include the drawer 340. The drawer 340 may be drawn out of the rear space or be put into the rear space. A user may introduce detergent into the drawer 340, and may then put the drawer 340 storing the detergent into the rear space.

A portion of the peripheral surface of the top cover 100 around the introduction opening may be open, and thus the drawer 340 may be put into and drawn out of the rear space through the portion of the peripheral surface around the introduction opening.

Meanwhile, FIG. 6 illustrates a passage, which is defined by coupling the installation unit 240 and through which detergent flows. FIG. 7 illustrates the storage body 210 and the internal storage 300, which are connected to each other via the passage.

Referring to FIGS. 6 and 7, the installation unit 240 may include the coupling pipe 242 connected to the storage body 210 coupled to the installation unit 240, and an outflow pipe 410 connected to the coupling pipe 242.

The detergent stored in the storage body 210 may be discharged and flow from the storage body 210 through the coupling pipe 242 and the outflow pipe 410. The outflow pipe 410 may connect the coupling pipe 242 to a detergent pump 400. In other words, the detergent discharged from the storage body 210 may be supplied to the detergent pump 400 through the outflow pipe 410.

The detergent pump 400 may be configured to pump the detergent stored in the storage body 210. Similar to the storage body 210, the detergent pump 400 may include a plurality of detergent pumps. For example, the plurality of detergent pumps 400 may include a first detergent pump 401 connected to the first storage body 211 and a second detergent pump 402 connected to the second storage body 212.

The detergent pump 400 may be provided in the rear space in the top cover 100. Consequently, the plurality of detergent pumps 400 may be shielded from the outside, and may be aligned with each other in the width direction Y of cabinet 10.

Furthermore, an embodiment of the present disclosure may include a pump control module 510, which is connected to the plurality of detergent pumps 400 so as to control operation of the plurality of detergent pumps 400.

The pump control module 510 may control the detergent pump 400 according to a preset standard to supply a certain amount of detergent to the tub 20 during execution of washing course. The pump control module 510 may be connected to a main control module or the control panel 50 of the front portion 120 via an electrical wire extending along the side lateral portion of the top cover 100.

Each of the coupling pipe 242 and the outflow pipe 410 may be composed of a pair, and may be connected to one of the first storage body 211 and the second storage body 212. The coupling pipes 242 may project from the central portion 241 in the width direction Y of the cabinet 10.

One of the coupling pipes 242 may project in one direction of the width direction Y from the central portion 241, and the other of the coupling pipes 242 may project in the opposite direction of the width direction Y from the central portion 241. The first storage body 211 and the second storage body 212 may be moved toward the central portion 241 from opposite sides of the width direction Y, and may then be coupled to the installation unit 240.

The first storage body 211 may include a facing end 2112 and a facing surface 2113 disposed on the facing end 2112, and the second storage body 212 may include a facing end 2122 and a facing surface 2123, which face the first storage body 211.

The facing end 2112 and the facing surface 2113 of the first storage body 211 may be disposed so as to face the second storage body 212, and the facing end 2122 and the facing surface 2123 of the second storage body 212 may be disposed so as to face the first storage body 211.

The facing end 2112 of the first storage body 211 and the facing end 2122 of the second storage body 212 may be positioned on the central portion 241, and may be supported by the central portion 241. The facing surface 2113 of the first storage body 211 and the facing surface 2123 of the second storage body 212 may be disposed on the central portion 241 so as to face each other.

The detergent pump 400 may be connected to the internal storage 300 via a detergent pipe 420. In other words, detergent outflowing from the storage body 210 may be supplied to the internal storage 300 via the coupling pipe 242, the outflow pipe 410, the detergent pump 400, and the detergent pipe 420. The internal storage 300 may include a receiving case 310 disposed in the rear space of the top cover 100, and the detergent pipe 420 may connect the detergent pump 400 and the receiving case 310 to each other.

Consequently, the detergent stored in the storage body 210 may be transferred to the internal storage 300. The receiving case 310 of the internal storage 300 may be configured to receive the drawer 340 in which detergent is stored.

The rear portion 130 of the top cover 100 may be provided with the water supply 600. The water supply 600 may include a water supply valve 610 adapted to intermit or allow flow of water, and a water supply pipe 620 through which water flows. The water supply pipe 620 may connect the water supply valve 610 to the receiving case 310 of the internal storage 300.

The receiving case 310 may include therein a water diffuser 370 adapted to increase a diffusing area of water transferred from the water supply 600. The drawer 340 may be positioned below the water diffuser 370 in the receiving case 310 such that the water transferred through the water diffuser 370 is supplied to the drawer 340.

The receiving case 310 may be open toward the introduction opening 101, and the water supplied to the receiving case 310 and the detergent in the storage body 210 may be discharged to the introduction opening 101 together with the detergent in the drawer 340, and may thus be supplied to the inside of the tub 20.

FIG. 8 illustrates the state in which the storage body 210 is separated from the installation unit 240, according to an embodiment of the present disclosure. FIG. 8 illustrates state in which the second storage body 212, which is representative one of the plurality of storage bodies 210, is separated from the installation unit 240.

According to an embodiment of the present disclosure, when the storage body 210 is moved from a first position P1 at which the storage body 210 is coupled to the installation unit 240 to a second position P2 which is spaced apart from the first position P1 in the width direction Y of the cabinet 10, the storage body 210 is capable of being separated from the installation unit 240. Here, the second position P2 may be defined within the width of the cabinet 10.

Referring to (a) of FIG. 8, specifically, the storage body 210 may be entirely positioned on the installation unit 240 in the state of being coupled to the installation unit 240. The position of the storage body 210 at which the storage body 210 is entirely coupled to the installation unit 240 may be defined as the first position P1.

At the first position P1, the first storage body 211 and the second storage body 212 may be positioned such that the facing surfaces 203 of the first storage body 211 and the second storage body 212 are in close contact with each other. In other words, the facing ends 2112 and 2122 of the first storage body 211 and the second storage body 212 may be positioned on the central portion 241, and the facing surfaces 2113 and 2123 thereof may be positioned adjacent to each other while facing each other.

At the first position P1, the outermost end E11 of the storage body 210 may be spaced inwards apart from the outermost end E21 of the installation unit 240 in the width direction Y. In other words, the outermost end E11 of the storage body 210 may be spaced apart from the outermost end E21 of the installation unit 240 toward the center of the installation unit 240.

Referring to (b) of FIG. 8, the storage body 210 may be moved in the width direction Y so as to be separated from the installation unit 240. The storage body 210 may be moved from the central portion 241 outwards in the width direction Y.

The storage 210 may be moved from the first position P1 in the width direction Y, and may be positioned at the second position P2 at which all of the coupling pipes 242 and the like are capable of being separated and of being removed from the installation unit 240. In other words, the storage body 210 may be moved outwards in the width direction Y from the first position P1 at which the storage body 210 is entirely coupled to the installation unit 240, and may then be moved to the second position P2 at which the storage body 210 is capable of being removed from the installation unit 240.

At the second position P2, the outermost end E11 of the storage body 210 may be positioned at the outermost end E21 of the installation unit 240 or may be spaced inwards from the outermost end E21 of the installation unit 240. At the second position P2, the outermost end E11 of the storage body 210 may be spaced apart from the outermost end E21 of the top cover 100 in the width direction Y.

In other words, the moving distance D1 of the storage that the storage body 210 slides on the installation unit 240 in the width direction Y may be less than or equal to the distance between the outermost ends E11 and E21 of the storage body 210 and the installation unit 240 at the first position P1.

In other words, at the second position P2, the storage body 210 may be entirely positioned on the top cover 100. Furthermore, at the second position P2, the boundary E1 of the storage body 210 may be positioned within the boundary E2 of the top cover 100.

Here, the term "boundary" means the boundary located at the periphery of an object when viewed from above. The above-mentioned outermost end may mean a portion the boundary which is defined based on the width direction Y. In other words, at any of the first position P1 and the second position P2, the storage body 210 may be positioned so as to entirely overlap the installation unit 240 in the upward and downward direction Z.

Referring to (c) of FIG. 8, the storage body 210, which has been moved outwards from the first position P1 in the width direction Y and then positioned at the second position P2, is capable of being lifted in the upward and downward direction Z by a user. Consequently, the storage body 210 may be completely removed from the installation unit 240.

The procedure by which the storage body 210, which has been separated from the installation unit 240, is again coupled to the installation unit 240 may be understood to be performed in the order of (c) of FIG. 8, (b) of FIG. 8, and (a) of FIG. 8. Specifically, the storage body 210 may be disposed at the second position P2, which is defined within the boundary E2, and may then slide inwards in the width direction Y so as to be coupled to the installation unit 240.

According to an embodiment of the present disclosure, the installation unit 240 may include the central portion 241, which projects upwards, and the seating surface 252, which extends from the central portion 241 in the width direction Y. The storage body 210 may be in contact with the central portion 241 at the first position P1, and may slide to the second position P2 along the seating surface 252 from the first position P1.

A portion of the storage body 210 that is positioned at the first position P1, that is, the facing end 202 of the storage body 210 may be positioned at the central portion 241, and at least a portion of the remaining portion of the storage body 210 may be positioned on the seating surface 252. In other words, at the first position P1, the ends of the first storage body 211 and the second storage body 212 that face each other may be positioned on the central portion 241.

The storage body 210 may include a plurality of storage bodies, that is, the first storage body 211 and the second storage body 212, and the seating surface 252 may be divided and disposed at opposite sides of central portion 241 in the width direction Y.

The first storage body 211 and the second storage body 212 may be in contact with each other at the first position P1, and may slide far away from the central portion 241 to the second position P2.

The laundry treatment apparatus 1 according to an embodiment of the present disclosure may be disposed in a dwelling space. For efficient use of the dwelling space, the laundry treatment apparatus 1 may be disposed near a wall or the like defining the dwelling space.

In an actual usage environment, there are many cases in which a space provided near the cabinet 10 of the laundry treatment apparatus 1 is insufficient. Accordingly, in the case in which the storage body 210 is capable of being separated only when the storage body 210 is moved in the width direction Y beyond the boundary E2 of the installation unit 240, it may be difficult to couple and separate the storage body 210 because a space sufficient for the installation unit 240 to move in the width direction Y is not assured.

In order to prevent this, since an embodiment of the present disclosure is constructed such that not only the first position P1 at which the storage body 210 is coupled to the installation unit 240 but also the second position P2 at which the storage body 210 is capable of being separated from the installation unit 240 are defined within the boundary E2 of the installation unit 240, it is possible to efficiently mount and separate the storage body 210 on and from the installation unit 240, regardless of a spatial allowance near the cabinet 10.

FIG. 9 illustrates a storage bottom portion 220 of the storage body 210 according to an embodiment of the present disclosure. According to an embodiment of the present disclosure, the storage body 210 may include the storage main body 213, and the storage bottom portion 220 defining the lower surface of the storage main body 213.

The facing end 202 and the facing surface 203 of the storage body 210 may be disposed so as to face the center of the installation unit 240 in the width direction Y, and may be positioned on the central portion of the installation unit 240 at the first position P1. The storage bottom portion 220 of the storage body 210 may be defined lower than the facing surface 203, and may include a detergent valve 225.

The detergent valve 225 may be provided at the storage bottom portion 220, and may be connected to the coupling pipe 242. The coupling pipe 242 may be inserted into the detergent valve 225 so as to communicate with the inside of the storage body 210. The detergent valve 225 may serve as a check valve adapted to block outflow of detergent when the coupling pipe 242 is not inserted into the detergent valve 225. The storage bottom portion 220 may be provided with an opening which is open in the width direction Y, and the detergent valve 225 may be provided at the opening.

The storage bottom portion 220 may be provided with a bottom damper 223. The bottom damper 223 may be configured to project downwards from the storage bottom portion 220, and may be brought into contact with the seating surface 252 of the installation unit 240 to function to support the storage body 210 with respect to the seating surface 252.

The storage bottom portion 220 may be provided with a variable protrusion 217 and a hook protrusion 227. The variable protrusion 217 may project downwards from the storage bottom portion 220 in such a manner that an amount by which the variable protrusion 217 projects is changeable.

The storage body 210 may include a variable button 218, which is operated in conjunction with the variable protrusion 217. An amount by which the variable protrusion 217 projects is changeable according to manipulation of the variable button 218. For example, the variable protrusion 217 may project by a first length in a first state of the variable button 218 and by a second length in a second state of the variable button 218.

A user may control a coupled state and a separated state of the storage body 210 by manipulating the variable button 218 and thus controlling a length by which the variable protrusion 217 projects. A detailed description of the variable protrusion 217 will be given later.

The hook protrusion 227 may project from the storage bottom portion 220 in the width direction Y. The hook protrusion 227 may be spaced apart from the variable protrusion 217 in the width direction Y. The hook protrusion 227 may be inserted into a hook groove 254 formed in the installation unit 240 so as to function to fix the storage body 210 to the installation unit 240.

Bottom side walls 222 may be disposed at front and rear sides of the storage bottom portion 220. The bottom side walls 222 may project downwards from the storage main body 213. The storage bottom portion 220 may be positioned between the pair of bottom side walls 222.

The bottom side walls 222 may be positioned at front and rear sides of the seating surface 252 of the installation unit 240. The seating surface 252 and the storage bottom portion 220 may be shielded from the outside by means of the bottom side walls 222, and the storage body 210 may slide in the width direction Y in the state in which the seating surface 252 is positioned between the pair of bottom side walls 222.

FIG. 10 illustrates the structure of the installation unit 240 according to an embodiment of the present disclosure.

Referring to FIG. 10, the installation unit 240 may include the seating surface 252 which extends from the central portion 241 in the width direction Y. The storage body 210 may be seated or slide on the seating surface 252.

The coupling pipe 242 may project from the inner side wall of the central portion 241 in the width direction Y. The coupling pipe 242 may be inserted into the detergent valve 225 of the storage body 210 in the width direction Y while the storage body 210 slides.

Installation outer walls are provided at front and rear sides of the seating surface 252. The installation outer walls may be configured so as to project higher than the seating surface 252 and to extend in the width direction Y. The installation outer walls may each have a stepped shape at outer sides of the seating surface 252.

The storage body 210 may slide in the width direction Y in the state in which the seating surface 252 and the installation outer walls are positioned between the pair of the bottom side walls 222. The storage body 210 may be immovable in the forward and backward direction X by virtue of the structural relationships between the bottom side walls 222 and the installation outer walls.

The installation unit 240 may include a projection 250. The projection 250 may be disposed at an outer side of the seating surface 252 in the width direction Y. The seating surface 252 may be positioned between the central portion 241 and the projection 250. The projection 250 may project higher than the seating surface 252.

The above-mentioned variable protrusion 217 may be positioned at an inner side of the projection 250 in the width direction Y, and the hook protrusion 227 may be positioned at an outer side of the projection 250 in the width direction Y. The outer surface of the projection 250 in the width direction Y may be provided therein with the hook groove 254 into which the hook protrusion 227 is inserted in the width direction Y.

FIG. 11 illustrates a cross-sectional view of the storage body 210 mounted on the installation unit 240. In other words, FIG. 11 illustrates the cross-section of the storage body 210 which is positioned at the first position P1.

At the first position P1, the outermost end E11, which is a portion of the boundary E1 of the storage body 210, may be spaced apart from the outermost end E21, which is a portion of the boundary E2 of the installation unit 240, in the width direction Y. The coupling pipe 242 may be inserted into the detergent valve 225 of the storage body 210 in the width direction Y.

Based on the width direction Y, the length D3 by which the coupling pipe 242 is inserted into the storage body 210 may be less than or equal to the distance D2 between the boundary E1 of the storage body 210 and the boundary E2 of the top cover 100.

In other words, the distance D2 between the outermost end E11 of the storage body 210 and the outermost end E21 of the installation unit 240 may be greater than the length D3 by which the coupling pipe 242 is inserted into the detergent valve 225.

In order to separate the storage body 210 from the installation unit 240, there is a need to completely separate the coupling pipe 242 from the detergent valve 225. Accordingly, since the distance D2 between the outermost end E11 of the storage body 210 and the outermost end and E21 of the installation unit 240 is set to be greater than the length D3 by which the coupling pipe 242 is inserted, the outermost end E11 of the storage body 210 may be positioned at an inner side of the outermost end E21 of the installation unit 240 in the width direction Y even when the coupling pipe 242 is completely separated.

Furthermore, based on the width direction Y, the length D3 that the coupling pipe 242 is inserted into the storage body 210 may be less than or equal to the distance D1 between the first position P1 and the second position P2. In other words, the length D3 that the coupling pipe 242 is inserted may be less than or equal to the distance D1 between the first position P1 and the second position P2.

Accordingly, the second position P2 of the storage body 210 at which the coupling pipe 242 is completely separated from the detergent valve 225 may be defined on the installation unit 240 within the boundary E2 of the installation unit 240.

The installation unit 240 may include the central portion 241, which projects upwards, and the seating surface 252, which extends from the central portion 241 in the width direction Y and on which the storage body 210 in the first position P1 is seated. The coupling pipe 242 may project from the central portion 241 in the width direction Y.

The coupling pipe 242 may be in communication with the tub 20, and thus the detergent in the storage body 210 may flow to the tub 20 via the coupling pipe 242.

The end of the installation unit 240 in the width direction Y may be provided with the hook groove 254 into which the hook protrusion 227 provided at the storage body 210 is inserted. The hook protrusion 227 may be positioned at an outer side than the hook groove 254 in the width direction Y, and may be inserted into the hook groove 254 in the width direction Y.

Specifically, the hook protrusion 227 may project from the storage bottom portion 220 of the storage body 210 in the width direction Y, and the hook groove 254 may be configured to be depressed in the width direction Y, as described above.

The hook groove 254 may be positioned at an inner side than the hook protrusion 227 in the width direction Y. Consequently, the hook protrusion 227 may project toward an inner side from an outer side of the hook groove 254, and may be inserted into the hook groove 254.

The hook protrusion 227 may be inserted into the hook groove 254 while the storage body 210 in the second position P2 slides to the first position P1. Here, the movement of the storage 210 in the upward and downward direction Z may be restricted by virtue of the relationships between the hook protrusion 227 and the hook groove 254.

Furthermore, based on the width direction Y, the length D4 that the hook protrusion 227 is inserted into the hook groove 254 may be less than or equal to the distance D2 between the boundary E1 of the storage body 210 and the boundary E2 of the top cover 100 at the first position P1.

In addition, based on the width direction Y, the length D4 by which the hook protrusion 227 is inserted into the hook groove 254 may be less than or equal to the distance D2 between the first position P1 and the second position P2.

Accordingly, as in the coupling pipe 242, the second position P2 of the storage body 210 at which the hook protrusion 227 is completely separated from the hook groove 254 may be defined within the boundary E2 of the installation unit 240.

As described above, the installation unit 240 may include the projection 250 which is provided with the hook groove 254 in the outer surface thereof in the width direction Y. The storage body 210 may include the variable protrusion 217 which is positioned so as to face the inner surface of the projection 250 at the first position P1. The projection 250 may be positioned between the variable protrusion 217 and the hook protrusion 227 to limit movement thereof in the width direction Y.

At the first position P1 at which the storage body 210 is completely coupled to the installation unit 240, the variable protrusion 217 and the hook protrusion 227 may be respectively positioned at opposite sides of the projection 250 in the width direction Y. Consequently, movement of the storage body 210 in the width direction Y may be limited by means of the variable protrusion 217 and the hook protrusion 227, and movement of the storage body 210 in the upward and downward direction Z may be limited by means of the coupling pipe 242 and the hook protrusion 227.

The projection 250 may include a protrusion support surface 255, which is formed on the inner surface of the projection 250 in the width direction Y so as to face the variable protrusion 217, and the hook groove 254, which is formed in the outer surface of the projection 250 in the width direction Y.

FIG. 12 illustrates the state in which the variable protrusion 217 is moved higher than the projection 250 at the first position P1.

The variable protrusion 217 is changeable in position. The variable protrusion 217 may be positioned so as to face the inner surface of the projection 250 in the first state, and may be positioned higher than the projection 250 so as to allow movement of the storage body 210 in the width direction Y.

The variable protrusion 217 may be moved in the upward and downward direction Z so as to vary an amount by which the variable protrusion projects with respect to the storage bottom portion 220. The variable protrusion 217 may face the inner surface of the projection 250, that is, the protrusion support surface 255 in the first state.

By virtue of the structural relationships between the variable protrusion 217 and the protrusion support surface 255, movement of the storage body 210 from the first position P1 toward the outer side in the width direction Y, that is, toward the second position P2 may be limited.

Meanwhile, when the variable protrusion 217 is positioned higher than the projection 250, which corresponds to the second state, the interference between the variable protrusion 217 and the protrusion support surface 255 may be eliminated. Consequently, movement of the storage body 210 toward the outer side in the width direction Y may be allowed, thus allowing the storage body 210 to be moved from the first position P1 to the second position P2.

FIG. 13 illustrates the state in which the variable protrusion 217 is positioned higher than the projection 250, which corresponds to the second state, and the storage body 210 is moved from the first position P1 to the second position P2, according to an embodiment of the present disclosure.

According to an embodiment of the present disclosure, the storage body 210 may be completely mounted on the installation unit 240 at the first position P1 by the variably protrusion 217 being changed to the first state, and may be allowed so as to be moved to the second position P2 from the first position P1 by the variable protrusion 217 being converted into the second state.

The storage body 210 may include the variable button 218 adapted to change the position of the variable protrusion 217. The variable button 218 may be configured so as to be exposed to the outside from the storage body 210, and a user may manipulate the variable button 218 to change an amount by which the variable protrusion 217 projects.

The variable button 218 may be disposed on the rear surface, the side lateral surface or the like of the storage body 210, and may be operated in conjunction with the variable protrusion 217. A user may move the storage body 210 between the first position P1 and the second position P2 by manipulating the variable button 218 to change the variable protrusion 217 to the second state, and may hold the storage body 210 to the installation unit 240 at the first position P1 by changing the variable protrusion 217 to the first state.

FIG. 14 illustrates the installation unit 240 and the storage body 210 according to an embodiment of the present disclosure when viewed in the width direction Y.

According to an embodiment of the present disclosure, the door 110 may be provided on the top cover 100 so as to open and close the introduction opening 101, and the storage 200 may be positioned behind the door 110.

In the forward and backward direction X of the cabinet 10, the storage body 210 may be positioned in front of the rear end E22 of the top cover 100 at the first position P1 and the second position P2.

In other words, the installation unit 240 may project rearwards farther than the storage body 210. The rear end E22 of the installation unit 240 may be positioned behind the rear end E12 of the storage body 210. The rear end E12 of the storage body 210 and the rear end E22 of the installation unit 240 may correspond to portions of the boundary E1 of the storage body 210 and the boundary E2 of the installation unit 240.

Accordingly, even when a wall defining a dwelling space is positioned behind the laundry treatment apparatus 1 according to an embodiment of the present disclosure, it is possible to efficiently prevent contact and the like between the wall and the storage body 210 during sliding movement of the storage body 210.

Although the present disclosure has been illustrated and described with reference to the specific embodiments, those skilled in the art will appreciate that various modifications, additions and substitutions are possible, without departing from the scope and spirit of the present disclosure as disclosed in the accompanying claims.

What is claimed is:

1. A laundry treatment apparatus comprising:

a cabinet including a top cover having an introduction opening;

a tub located in the cabinet, the tub being configured to store water therein, the tub having a tub opening facing the introduction opening; and a storage located at the top cover, the storage configured to store detergent therein, at least a portion of the storage being exposed to outside of the cabinet, the storage including:

an installation unit located at the top cover, the installation unit being in communication with the tub; and a storage body removably coupled to the installation unit, the storage body being configured to store the detergent therein, wherein the storage body is capable of being separated from the installation unit when moved from a first position at which the storage body is coupled to the installation unit to a second position which is spaced apart from the first position in a width direction of the cabinet, and wherein the storage body is removable within a boundary of the cabinet.

2. The laundry treatment apparatus of claim 1, wherein the storage body is entirely located on the top cover at the second position.

3. The laundry treatment apparatus of claim 1, wherein a boundary of the storage body is located within a boundary of the top cover at the second position.

4. The laundry treatment apparatus of claim 1, wherein an outermost end of the storage body in the width direction of the cabinet is spaced apart from an outermost end of the top cover in the width direction of the cabinet at the second position.

5. The laundry treatment apparatus of claim 1, wherein the installation unit includes:

a central portion protruding upwards; and a seating surface extending from the central portion in the width direction of the cabinet, wherein the storage body contacts the central portion when at the first position, and wherein the storage body is slidable along the seating surface when moving from the first position to the second position.

6. The laundry treatment apparatus of claim 5, wherein, when the storage body is at the first position, a portion of the storage body is located on the central portion, and at least a portion of a remaining portion of the storage body is located on the seating surface.

7. The laundry treatment apparatus of claim 5, wherein the storage body further includes a first storage body and a second storage body, wherein the seating surface includes a first seating surface and a second seating surface located at opposite sides of the central portion in the width direction of the cabinet, wherein the first storage body and the second storage body contact the central portion at the first position, and wherein the first storage body and the second storage body are slidable away from the central portion when moving from the first position to the second position.

8. The laundry treatment apparatus of claim 7, wherein, at the first position, an end of the first storage body and an end of the second storage body face each other and are located on the central portion.

9. The laundry treatment apparatus of claim 1, wherein the installation unit includes a coupling pipe configured to be inserted into the storage body when the storage body is at the first position, and wherein, based on the width direction of the cabinet, a length of the coupling pipe that is inserted into the storage body is less than or equal to a distance between a boundary of the storage body and a boundary of the top cover when the storage body is at the first position.

10. The laundry treatment apparatus of claim 9, wherein, based on the width direction of the cabinet, the length by which the coupling pipe is inserted into the storage body is less than or equal to a distance the storage body moves between the first position and the second position.

11. The laundry treatment apparatus of claim 9, wherein the installation unit further includes:

a central portion protruding upwards; and a seating surface extending from the central portion in the width direction of the cabinet, wherein the storage body is seated on the seating surface when the storage body is at the first position, and wherein the coupling pipe extends from the central portion in the width direction of the cabinet.

12. The laundry treatment apparatus of claim 9, wherein the coupling pipe is in communication with the tub such that the detergent stored in the storage body is configured to flow to the tub through the coupling pipe.

13. The laundry treatment apparatus of claim 1, wherein an end of the installation unit in the width direction of the cabinet includes a hook groove, and wherein the storage body includes a hook protrusion configured to be inserted into the hook groove of the installation unit when the storage body is at the first position.

14. The laundry treatment apparatus of claim 13, wherein, based on the width direction of the cabinet, a length by which the hook protrusion is inserted into the hook groove is less than or equal to a distance between a boundary of the storage body and a boundary of the top cover when the storage body is at the first position.

15. The laundry treatment apparatus of claim 13, wherein, based on the width direction of the cabinet, a length by which the hook protrusion is inserted into the hook groove is less than or equal to a distance the storage body moves between the first position and the second position.

16. The laundry treatment apparatus of claim 13, wherein the installation unit further includes a projection having an outer surface and an inner surface, the hook groove being located in the outer surface, wherein the storage body further includes a variable protrusion configured to face the inner surface of the projection when the storage body is at the first position, and wherein the projection is located between the variable protrusion and the hook protrusion so as to restrict movement of the storage body in the width direction of the cabinet when the storage body is at the first position.

17. The laundry treatment apparatus of claim 16, wherein the variable protrusion is adjustable in a vertical direction of the cabinet such that the variable protrusion is located to face the inner surface of the projection in a first state and is located higher than the projection in a second state so as to allow movement of the storage body in the width direction.

18. The laundry treatment apparatus of claim 17, wherein the storage body comprises a variable button configured to move the variable protrusion from the first state to the second state.

19. The laundry treatment apparatus of claim 1, further comprising a door at the top cover, the door being configured to open and close the introduction opening, wherein the storage is located rearward of the door.

20. The laundry treatment apparatus of claim 19, wherein the storage body is located forward of a rear end of the top cover at the first position and the second position.

* * * * *